US008128359B2

(12) United States Patent
Chen

(10) Patent No.: US 8,128,359 B2
(45) Date of Patent: Mar. 6, 2012

(54) AIR FAN MODULE AND A FLOW DIRECTING BLADE ASSEMBLY THEREOF

(75) Inventor: Chi-An Chen, Taoyuan County (TW)

(73) Assignees: Listan Asia Inc., Taoyuan County (TW); Listan GmbH & Co., KG, Glinde (DE)

( * ) Notice: Subject to any disclaimer, the term of this patent is extended or adjusted under 35 U.S.C. 154(b) by 455 days.

(21) Appl. No.: 12/402,502

(22) Filed: Mar. 12, 2009

(65) Prior Publication Data

US 2010/0232971 A1 Sep. 16, 2010

(51) Int. Cl.

| | |
|---|---|
| ***F03D 1/04*** | (2006.01) |
| ***F03B 1/00*** | (2006.01) |
| ***F03B 3/04*** | (2006.01) |

(52) U.S. Cl. ..... 415/220; 415/115; 415/140; 416/223 R

(58) Field of Classification Search ..... 415/115, 415/140, 141, 156, 175, 180, 220; 416/223 R
See application file for complete search history.

(56) References Cited

U.S. PATENT DOCUMENTS

| | | | | |
|---|---|---|---|---|
| 6,071,078 | A * | 6/2000 | Schlegel et al. | 416/247 R |
| 7,301,768 | B2 * | 11/2007 | Fan et al. | 361/695 |
| 7,349,211 | B2 * | 3/2008 | Chen et al. | 361/695 |
| 7,385,813 | B2 * | 6/2008 | Lin | 361/695 |

FOREIGN PATENT DOCUMENTS

| | | |
|---|---|---|
| CN | 1590778 | 3/2005 |
| TW | 590272 | 6/2004 |
| TW | 595661 | 6/2004 |

* cited by examiner

*Primary Examiner* — David Nhu
(74) *Attorney, Agent, or Firm* — Muncy, Geissler, Olds & Lowe, PLLC

(57) ABSTRACT

An air fan module and a flow directing blade assembly thereof aim to reduce noises generated during operation of the air fan caused by friction between blades and air and improve cooling efficiency. The air fan module includes a fan frame which has an air inlet, an air outlet and a housing space formed between them to hold a flow directing blade assembly. The flow directing blade assembly has an axis and a plurality of blades mounted onto the axis. Each blade has a first end surface and a second end surface. The first and second end surfaces have respectively a plurality of first flow directing portions and second flow directing portions that are respectively spaced from each other and formed in an asymmetrical manner. Air can form steady airflow by channeling of the first flow directing portions and the second flow directing portions of two neighboring blades.

14 Claims, 5 Drawing Sheets

AIR FAN MODULE AND A FLOW DIRECTING BLADE ASSEMBLY THEREOF

FIELD OF THE INVENTION

The present invention relates to an air fan module and a flow directing blade assembly thereof and particularly to an air fan module and a flow directing blade assembly to provide steady airflow to enhance cooling effect and reduce operational noise.

BACKGROUND OF THE INVENTION

Electronic devices are widely used in people's life and work environment now. Those electronic devices mostly include a lot of different electronic elements connecting together to achieve various purposes. The electronic elements usually generate heat during operation and result in a lower efficiency or even operation interruption. Hence heat sinks are commonly adopted on the heated electronic elements or nearby to quickly dissipate the heat generated during operation of the electronic elements to lower operation temperature and ensure regular operation thereof. To meet such a purpose, cooling fans are widely adopted. And achieving a higher cooling efficiency of the cooling fans is an important issue. Conventional focus on this issue usually aims to alter blade and frame structures, or increase air fan rotation speed to enhance intake airflow amount and exit airflow amount to boost cooling efficiency. However, increasing airflow amount and air fan rotation speed generate greater impact and friction between the air and blades during air fan operation, and produce greater operational noise caused by wind shearing. As a result, the cooling effect of the air fan suffers.

To remedy the aforesaid problems, the techniques of adopting a flow directing structure on the air fan blades to channel airflow motion have been proposed in prior art. For instance, R.O.C. patent No. 590272 discloses an improved cooling fan which has a plurality of blades arranged on the periphery of the axis of an air fan in an annular array fashion. Each of the blades has a bottom surface formed with a plurality of jutting ribs arched towards the axis. When the air fan rotates, the blades generate cooling airflow blowing downwards. The jutting ribs direct the cooling airflow below the axis to prevent generation of turbulence and noises, and also to increase cooling efficiency.

Another R.O.C. patent No. 595661 discloses improved blades for an extractor fan. It has a hub in the center and a plurality of blades around the hub. The blades are spaced from each other with a desired gap. Each blade has an inner surface on which jutting directing ridges are formed in the rotation direction. Between the ridges a flow directing portion is formed. The blade further has an inward concave portion at one side corresponding to the flow directing direction. When the blades rotate, air is converged along the flow directing portion and channeled to the inward concave portion and discharged through the gap between the blades and the inward concave portion. Such a structure can steady airflow and reduce the impact noise of the air and the blades. Moreover, the inward concave portion can quickly direct discharge of the airflow, thus improve air discharge efficiency and lower the noise.

China patent No. CN1590778 discloses an axial flow fan which has a pressure surface on the blades. The axial flow fan has ribs extended from the front side thereof to the rear side of the blades in parallel with the rotation track of the blades to direct airflow during operation.

All the conventional techniques mentioned above have a common feature: namely the airflow directing structure of the air fan is located at the bottom surface of the blades (i.e. airflow exit surface) to direct and form airflow. In practice, airflow first hits the top surface of one blade (i.e. air intake surface), then hits the bottom surface of a neighboring blade due to air fan rotation. As the aforesaid conventional techniques have the airflow directing structure formed merely on the bottom surface of each blade, the blade receives an uneven force. Not only operational noise problem cannot be improved, cooling efficiency also is lower due to poorer airflow directing effect.

SUMMARY OF THE INVENTION

The primary object of the present invention is to solve the aforesaid disadvantages by providing a flow directing structure at two sides of air fan blades to improve flow directing effect and reduce noise generated during air fan operation.

To achieve the foregoing object, the present invention provides an air fan module and a flow directing blade assembly thereof. The air fan module includes a fan frame and a flow directing blade assembly. The fan frame has an air inlet, an air outlet and a housing space between them to hold the flow directing blade assembly. The flow directing blade assembly has an axis and a plurality of blades mounted onto the axis. Each blade has a first end surface and a second end surface that have respectively a plurality of first flow directing portions and second flow directing portions. The first and second flow directing portions are spaced from each other in an asymmetrical manner. Hence air between two neighboring blades is channeled from the first flow directing portions of one blade to the second flow directing portions of another blade to form steady airflow.

By means of the structure set forth above, compared with the conventional techniques, the present invention can improve air fan cooling effect and reduce operational noise.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
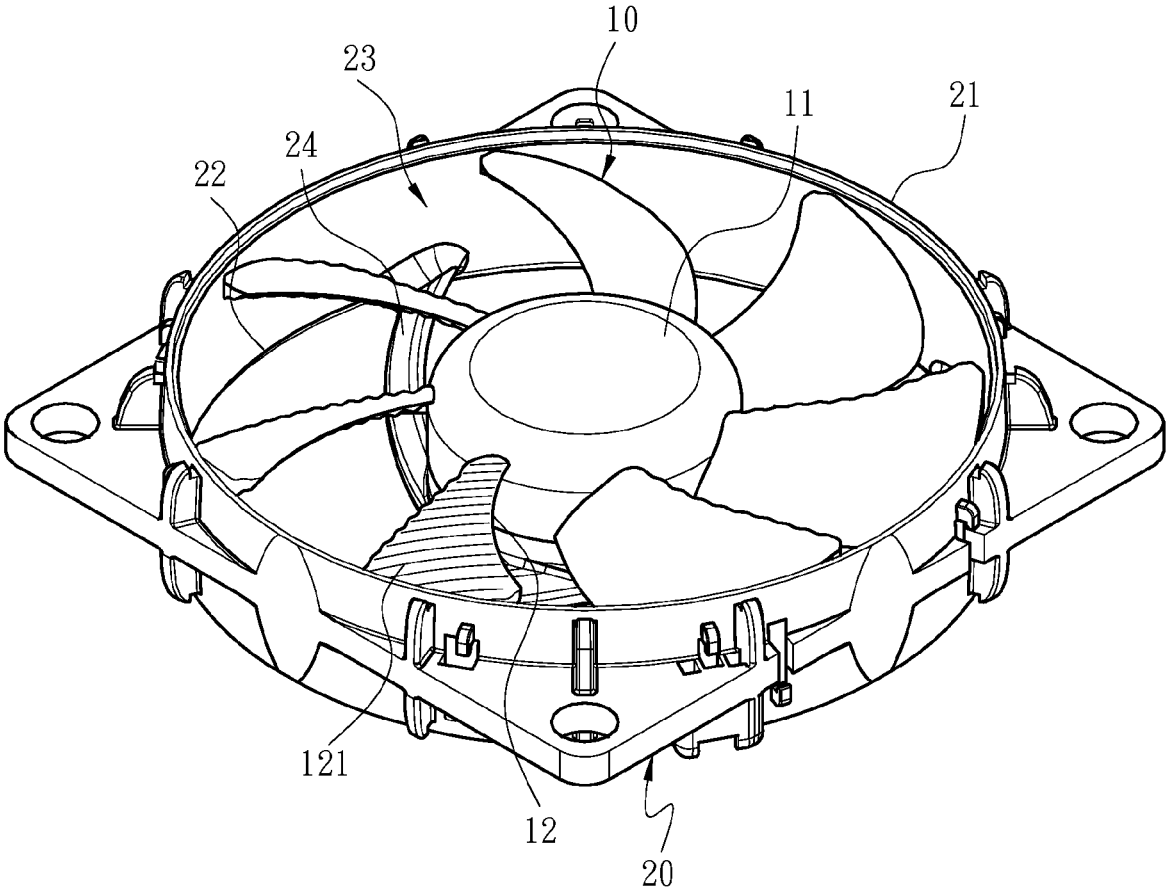
FIG. 1 is a perspective view of the invention.
Figure 2:
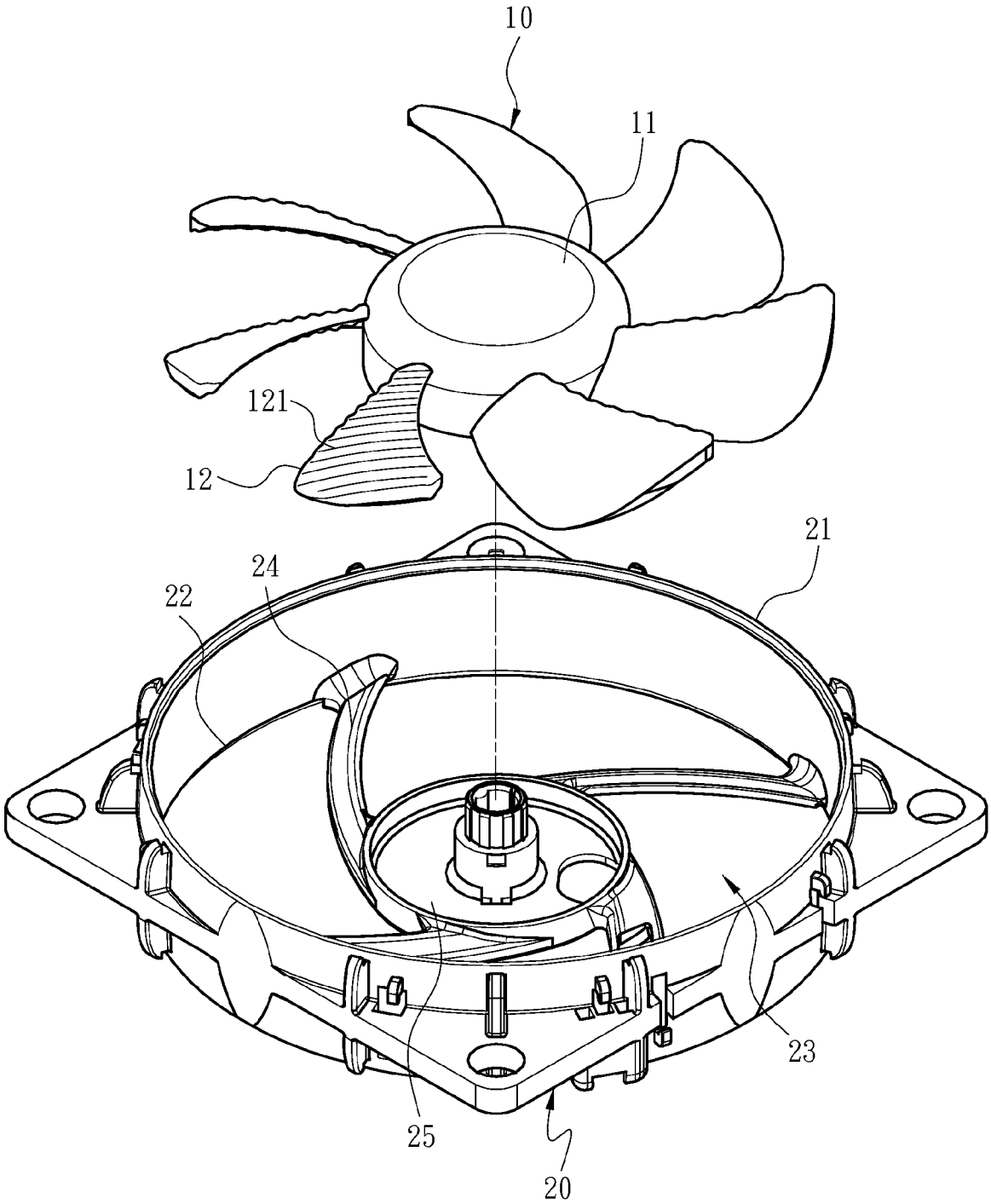
FIG. 2 is an exploded view of the invention.
Figure 3A:
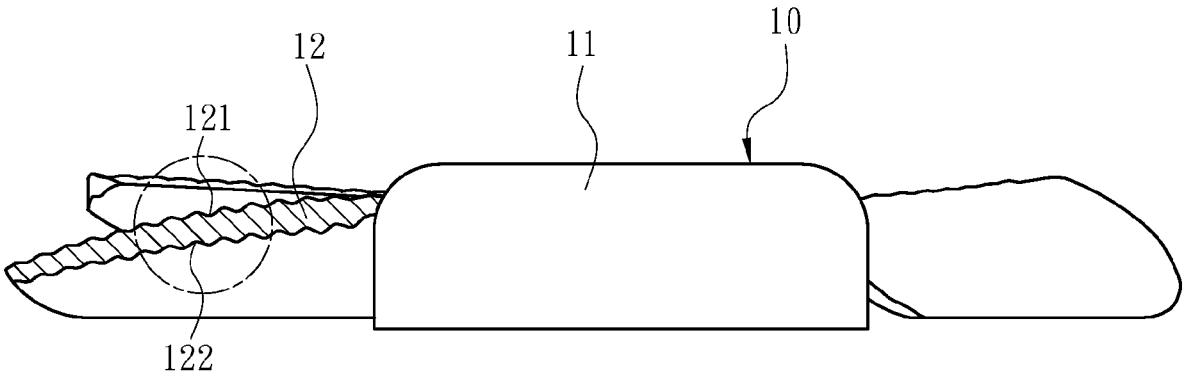
FIG. 3A is a side view of a first embodiment of the flow directing blade assembly of the invention, partly cutaway.
Figure 3B:
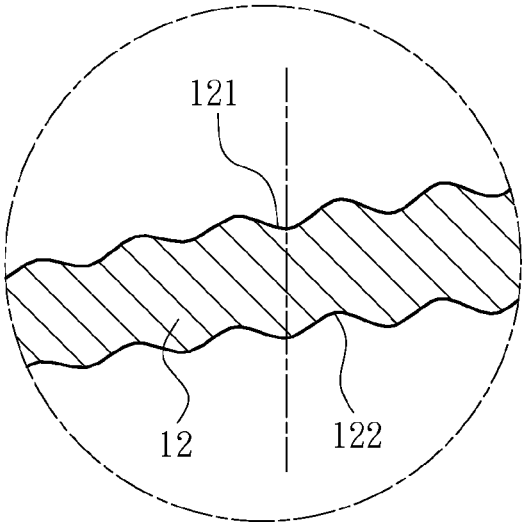
FIG. 3B is a fragmentary cross section according to FIG. 3A.

Please refer to FIGS. 1 and 2, the air fan module and the flow directing blade assembly thereof according to the invention are adaptable to axial flow fans or centrifugal fans. The air fan module includes a fan frame 20 and a flow directing blade assembly 10 located in the fan frame 20. The fan frame 20 has an air inlet 21, an air outlet 22 and a housing space 23 between them. The fan frame 20 further has a plurality of ribs 24 and a hub 25 linking to the ribs 24 in the housing space 23 to support the flow directing blade assembly 10. The flow directing blade assembly 10 has an axis 11 in the hub 25 and a plurality of blades 12 around the axis 11. Also referring to FIGS. 3A and 3B, each of the blades 12 has a first end surface and a second end surface. The first end surface is an air intake surface of the flow directing blade assembly 10 corresponding to the air inlet 21 of the fan frame 20. The second end surface is an air exit surface of the flow directing blade assembly 10 corresponding to the air outlet 22 of the fan frame 20. The first and second end surfaces further have respectively a plurality of first flow directing portions 121 and second flow directing portions 122 that are spaced from each other and formed in an asymmetrical manner. In an embodiment, the first and second flow directing portions 121 and 122 are arched grooves to channel air to form airflow, thereby to enhance cooling efficiency and reduce operational noise.

Figure 4:
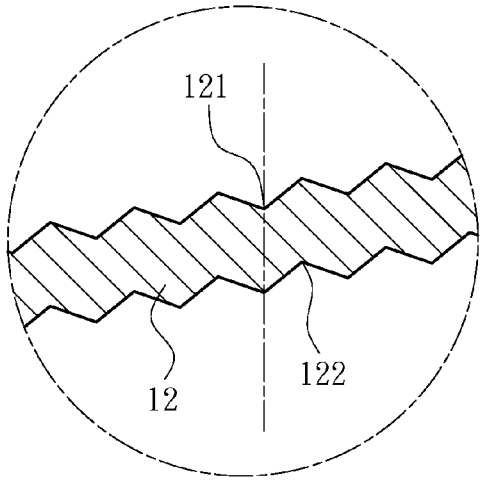
FIG. 4 is a fragmentary cross section of a second embodiment of the flow directing blade assembly of the invention.
Figure 6:
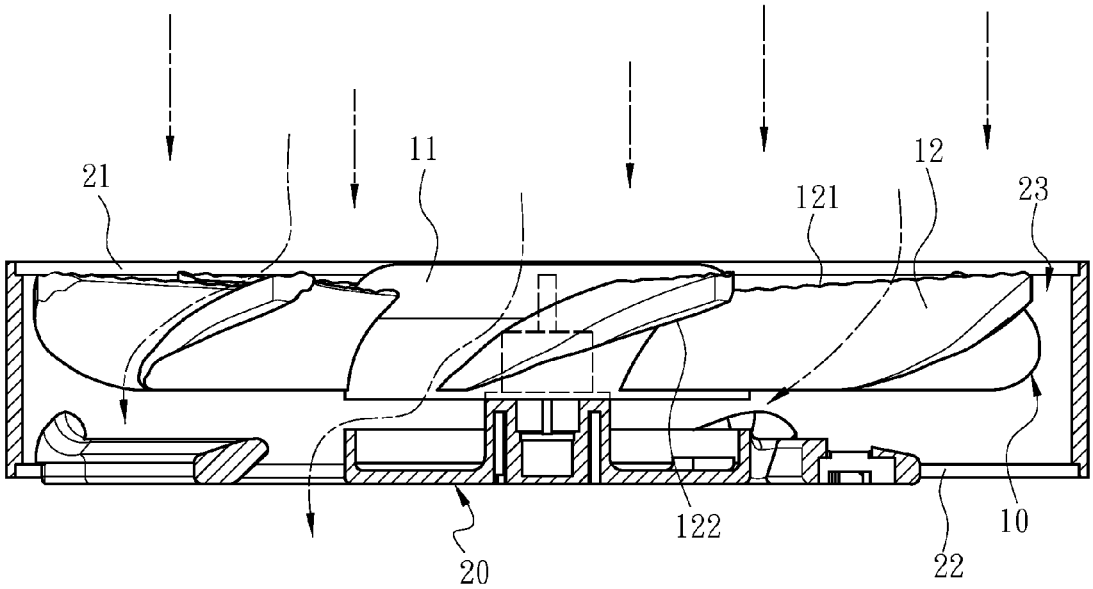
FIG. 6 is a schematic view of airflow traveling paths according to the invention.
Figure 5:
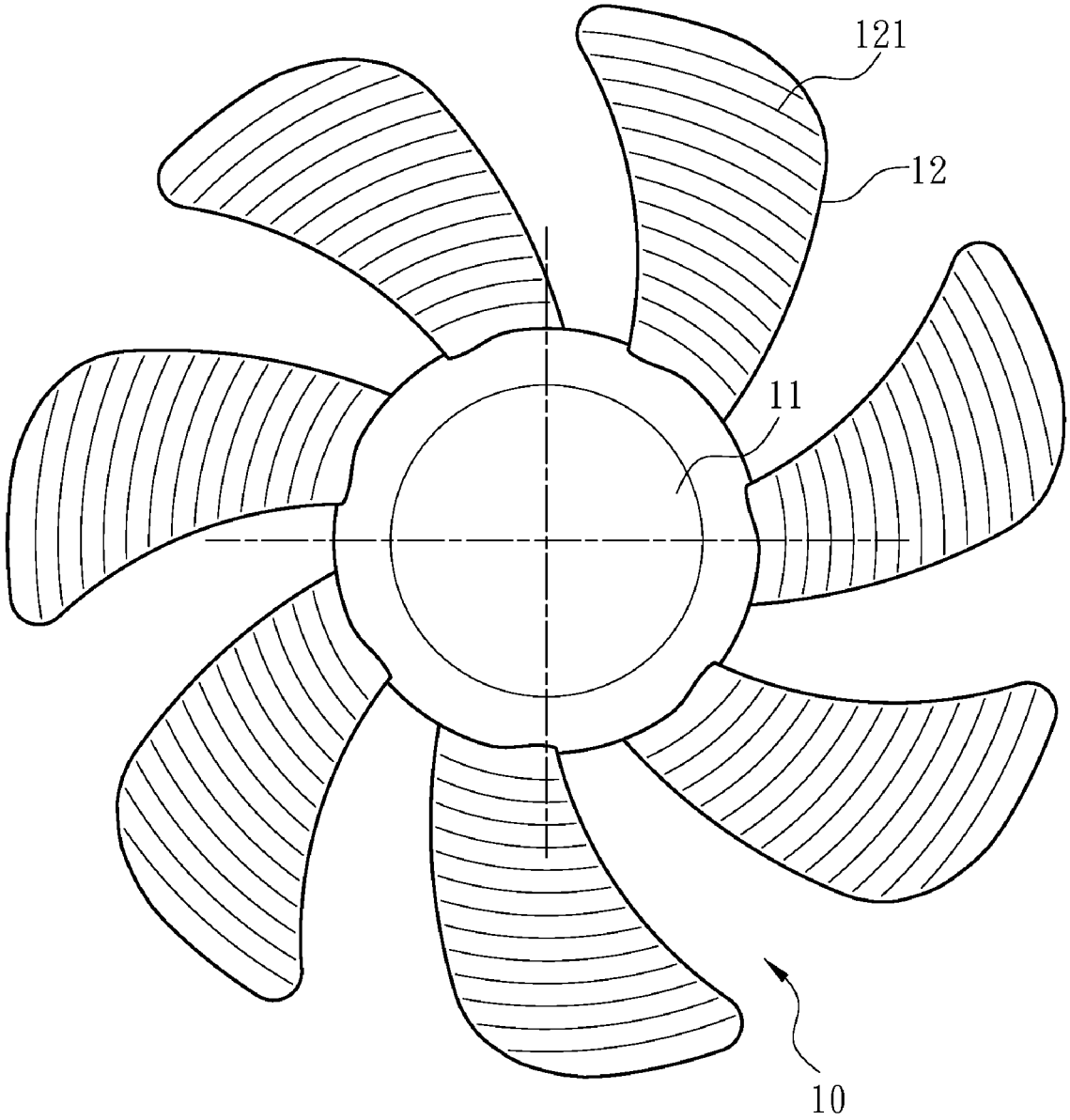
FIG. 5 is a top view of the flow directing blade assembly of the invention.

Aside from forming the first and second flow directing portions 121 and 122 in the arched grooves as previously discussed, referring to FIG. 4, the first and second flow directing portions 121 and 122 may also be formed in saw-shaped grooves and in parallel with each other. Also referring to FIG. 5, the first and second flow directing portions 121 and 122 are formed in a coaxial manner relative to the rotation track of the flow directing blade assembly 10. Thereby during air fan operation, air is channeled by the parallel and coaxial first and second flow directing portions 121 and 122 to become steady airflow. Referring to FIG. 6, the air enters through the air inlet 21, and initially hits the first flow directing portions 121 of the flow directing blade assembly 10. Through directing of the first flow directing portions 121 and the rotation of the flow directing blade assembly 10, the air hits the second flow directing portions 122 of a neighboring blade 12 and is channeled by the second flow directing portions 122 to be discharged through the air outlet 22. Thus the air between the neighboring blades 12 is channeled by the first and second flow directing portions 121 and 122 of the two neighboring blades 12 to form airflow.

As a conclusion, the present invention provides the blades 12 with the first and second flow directing portions 121 and 122 formed respectively on the first and second end surfaces and spaced from each other asymmetrically. Hence the air between the two neighboring blades 12 can be channeled by the first flow directing portions 121 of one blade 12 and the second flow directing portions 122 of another blade 12 to form steady airflow. Not only operational noise is lower, air fan cooling efficiency also is higher. Thus it provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A flow directing blade assembly installed on an air fan, comprising an axis and a plurality of blades mounted onto the axis, wherein:

each of the plurality of blades has a first end surface and a second end surface, the first end surface having a plurality of first flow directing portions, the second end surface having a plurality of second flow directing portions, the first flow directing portions and the second flow directing portions being spaced respectively from each other in an asymmetrical manner.

2. The flow directing blade assembly of claim 1, wherein the first flow directing portions and the second flow directing portions are formed coaxially along a rotational track of the flow directing blade assembly.

3. The flow directing blade assembly of claim 1, wherein the first flow directing portions and the second flow directing portions are parallel with each other.

4. The flow directing blade assembly of claim 1, wherein the first flow directing portions and the second flow directing portions are formed in arched grooves.

5. The flow directing blade assembly of claim 1, wherein the first flow directing portions and the second flow directing portions are formed in saw-shaped grooves.

6. The flow directing blade assembly of claim 1, wherein the first end surface and the second end surface are respectively an air intake surface and an air exit surface of the flow directing blade assembly.

7. An air fan module, comprising:

a fan frame having an air inlet, an air outlet and a housing space between the air inlet and the air outlet; and a flow directing blade assembly which is located in the housing space and has an axis and a plurality of blades mounted onto the axis, each of the plurality of blades having a first end surface and a second end surface, the first end surface having a plurality of first flow directing portions, the second end surface having a plurality of second flow directing portions, the first flow directing portions and the second flow directing portions being spaced respectively from each other in an asymmetrical manner.

8. The air fan module of claim 7, wherein the air fan module is selectively an axial flow fan or a centrifugal fan.

9. The air fan module of claim 7, wherein the first end surface is an air intake surface corresponding to the air inlet and the second end surface is an air exit surface corresponding to the air outlet.

10. The air fan module of claim 7, wherein the fan frame has a plurality of ribs and a hub connecting to the ribs to hold the axis of the flow directing blade assembly.

11. The air fan module of claim 7, wherein the first flow directing portions and the second flow directing portions are formed coaxially along a rotational track of the flow directing blade assembly.

12. The air fan module of claim 7, wherein the first flow directing portions and the second flow directing portions are parallel with each other.

13. The air fan module of claim 7, wherein the first flow directing portions and the second flow directing portions are formed in arched grooves.

14. The air fan module of claim 7, wherein the first flow directing portions and the second flow directing portions are formed in saw-shaped grooves.

* * * * *